United States Patent [19]

Imajou

[11] Patent Number: 5,036,801

[45] Date of Patent: Aug. 6, 1991

[54] DOUBLE CYCLE INTERNAL COMBUSTION ENGINE

[75] Inventor: Minoru Imajou, Yokohama, Japan

[73] Assignee: Nissan Motor Co., Ltd., Yokohama, Japan

[21] Appl. No.: 359,778

[22] Filed: May 31, 1989

[30] Foreign Application Priority Data

Jun. 2, 1988 [JP] Japan ..... 63-136559

[51] Int. Cl.[5] ..... F02B 69/06

[52] U.S. Cl. ..... 123/21; 123/DIG. 7

[58] Field of Search ..... 123/65 R, 64, 21, DIG. 7

[56] References Cited

U.S. PATENT DOCUMENTS

| | | | |
|---|---|---|---|
| 1,077,363 | 11/1913 | Nash . | |
| 2,304,407 | 12/1942 | Hogan . | |
| 3,100,478 | 8/1963 | Crooks | 123/21 |
| 4,392,459 | 7/1983 | Chareire | 123/21 |
| 4,572,114 | 2/1986 | Sickler | 123/21 |
| 4,664,070 | 5/1987 | Meistrick et al. | 123/21 |

FOREIGN PATENT DOCUMENTS

| | | |
|---|---|---|
| PH0729 | 5/1985 | Australia . |
| 0223767 | 5/1987 | European Pat. Off. . |
| 58-152139 | 9/1983 | Japan . |
| WO/87/005-75 | 1/1987 | World Int. Prop. O. . |

*Primary Examiner*—David A. Okonsky
*Attorney, Agent, or Firm*—Foley & Lardner

[57] ABSTRACT

To simplify the structure of a double (two and four) cycle internal combustion engine, the engine comprises a cylinder formed with a scavenging port and an exhaust port, a piston, a fuel injection valve, a fuel ignition plug, an air flowmeter, a crank angle sensor, and a controller for switching the engine operation from 2 cycle mode to 4 cycle mode or vice versa according to engine operating condition (engine speed and load) and for activating the fuel injection valve and the fuel ignition plug every engine revolution in two cycle mode and every two engine revolutions in four cycle mode. Since the engine operation mode can be switched by only changing the fuel injection and ignition timings through the controller, the intake and exhaust valves will not be complicated without need of any additional valve actuating mechanisms.

12 Claims, 3 Drawing Sheets

DOUBLE CYCLE INTERNAL COMBUSTION ENGINE

BACKGROUND OF THE INVENTION

1. Field of the Invention

The present invention relates to a double cycle internal combustion engine whose combustion operation can be switched from two cycle mode to four cycle mode or vice versa as occasion demands.

2. Description of the Prior Art

Internal combustion engines of a reciprocation type can be classified into two cycle engines and four cycle engines from the structural standpoint. In the two cycle engine, since fuel is burnt once for each piston reciprocation, the number of explosions is large and therefore there exists such an advantage that a high power can be outputted in spite of a small size. However, there exists a problem in that the fuel consumption rate is not low, because it is rather difficult to effect perfect scavenging and exhausting operations. An example of these two cycle engines is disclosed in Japanese Published Unexamined (Kokai) Patent Application No. 63-32256.

In contrast with this, in the case of the four cycle engine, since fuel is burnt once every two piston reciprocations, reliable suction and exhaustion operations can be effected and therefore fuel can be burnt perfectly so that the fuel consumption rate is low. However, there exists another problem in that the four cycle engine is inferior to the two cycle engine with respect to high speed revolution and high output power.

To overcome the above-mentioned problems, there has been proposed an engine whose combustion operation can be switched to the four cycle mode when the engine is being operated under a relatively low load (partial load operation) to improve the fuel consumption rate, and to the two cycle mode when the engine is being operated under a relatively high load (full load operation) to obtain a high output power.

In the above-mentioned prior-art two and four cycle switchable internal combustion engine, however, there exists a problem in that the mechanism or the structure for switching the operation modes is very complicated and therefore large in scale.

In the case of the engine as disclosed in the above-mentioned application (JP-58-152139), for instance, since the operation modes are switched by switching the operating timing of the suction and exhaust valves, a two cycle cam and a four cycle cam are both attached to a cam shaft and these two cams are switched by sliding the cam shaft in the axial direction thereof, so that the structure of the operating valves are complicated markedly.

SUMMARY OF THE INVENTION

With these problems in mind, therefore, it is the primary object of the present invention to provide a double cycle internal combustion engine which can switch combustion operation from two cycle mode to four cycle mode or vice versa in spite of simplified mode switching and valve structures.

To achieve the above-mentioned object, the double cycle internal combustion engine, according to the present invention comprises: (a) a cylinder formed with a scavenging port and an exhaust port; (b) a piston slidably fitted to said cylinder, the scavenging and exhaust ports being opened or closed, respectively when said piston is slidably moved within said cylinder; (c) a fuel injection valve, provided near an upper portion of said cylinder, for injecting fuel into said cylinder; (d) a fuel ignition plug, also provided near the upper portion of said cylinder, for igniting a mixture of fuel injected through said fuel injection valve and air introduced through the scavenging port into said cylinder; (e) detecting means for detecting engine operating conditions; and (f) control means, coupled to said fuel injection valve, said fuel ignition plug, and said detecting means, for switching engine operation from a two cycle mode to a four cycle mode or vice versa according to the engine operating conditions detected by said detecting means, and for activating said fuel injection valve and said fuel ignition plug every engine revolution in two cycle mode and every two engine revolutions in four cycle mode.

The engine operating conditions are engine load and engine speed. When the engine load and speed are both lower than predetermined medium values, respectively, the engine operating mode is switched to the four cycle mode; when the engine load and speed are both the predetermined medium values or higher, respectively, the engine operation mode is switched to the two cycle mode. Further, it is also preferable to provide a mode selection switch for manually switching the engine operation mode from two to four cycle mode or vice versa.

A one-way valve is disposed between the scavenging port and an engine intake passage, and an intake throttle valve is disposed in the engine intake passage so as to be operated in linkage with an accelerator pedal in the two cycle mode. Further, an exhaust control valve is disposed in the exhaust port, and a servomotor is connected to the exhaust control valve so that the opening rate thereof can be adjusted according to engine operating conditions.

Further, to achieve the above-mentioned object, the method of operating a double cycle internal combustion engine according to the present invention comprises the steps of: (a) detecting an amount $Q_a$ of air introduced into an engine cylinder; (b) detecting crank signals indicative of crank angular positions; (c) calculating engine speed on the basis of the detected crank signals; (d) calculating engine load on the basis of the detected air amount and the calculated engine speed; (e) determining either one of two and four engine operation cycles according to the calculated engine load and speed; (f) determining an amount $Q_f$ of fuel to be injected on the basis of the calculated load and the determined cycle; (g) determining a fuel injection timing $I_f$ on the basis of the calculated engine load and speed in synchronism with a crank signal; (h) determining a fuel ignition timing $I_a$ on the basis of the calculated engine load and speed in synchronism with a crank signal; (i) determining fuel injection and ignition intervals on the basis of the determined engine operation; (j) activating a fuel injection valve on the basis of the determined fuel injection amount, timing and intervals; and (k) activating a fuel ignition plug on the basis of the determined ignition timing and intervals.

In the double cycle internal combustion engine according to the present invention, whenever the engine operation cycle is switched, since only the fuel injection and ignition intervals are switched by the control means and the exhaust control valve is opened or closed by the servomotor both according to the determined engine operation cycle, it is possible to realize a double cycle engine without complicating the valve and valve actuator structures. In the two cycle mode, fuel is injected and ignited every engine revolution to increase the engine speed and power. In the four cycle mode, fuel is injected and ignited every two engine revolutions to improve the fuel consumption rate and exhaust performance.

DETAILED DESCRIPTION OF THE PREFERRED EMBODIMENTS

Figure 1:
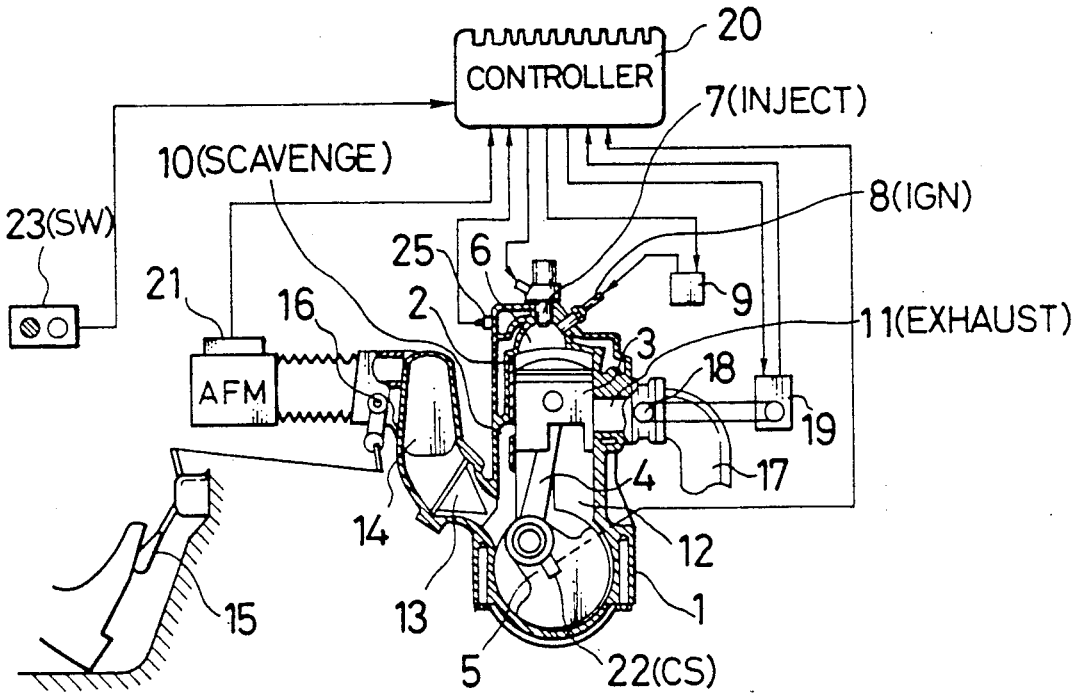
FIG. 1 is a longitudinal cross-sectional view showing an embodiment of the present invention.

An embodiment of the present invention will be described hereinbelow with reference to the attached drawings.

An engine body 1 includes a cylinder 2, within which a piston 3 is slidably disposed. The reciprocating motion of the piston 3 is converted into rotary motion via a connecting rod 4 and a crankshaft 5.

Within a combustion chamber 6 over the piston 3., there are arranged a fuel injection valve 7 for directly injecting fuel and an ignition plug 8 for igniting the injected fuel for combustion. A high tension ignition current is supplied from an ignition coil 9 to the ignition plug 8.

A scavenging port 10 and an exhaust port 11 located a little above the port 10 are formed midway in an inner wall of the cylinder 2. The scavenging port 10 communicates with a crank prepressurization chamber 12 and further with an intake passage 14 via a reed valve (one-way valve) 13. An intake throttle valve 16 whose opening rate is adjusted in linkage with an accelerator pedal 15 is disposed within the intake passage 14.

On the other hand, the exhaust port 11 communicates with an exhaust passage 17. In this embodiment, a swing vane exhaust control valve 18 is disposed midway in the exhaust passage 17 so that the opening rate thereof can be adjusted by a servomotor 19 according to engine operating conditions.

A controller (e.g. a microcomputer) 20 is provided for controlling fuel injection through the fuel injection valve 7 and ignition operation through the ignition plug 8, and exhaust operation through the servomotor 19 and the exhaust control valve 18.

The controller 20 receives various sensor signals from an air flowmeter 21 for measuring the amount of intake air, a crank angle sensor 22 for detecting engine rotative speed and crank angular position, and an engine temperature sensor 25 and switch signals from an operation mode selection switch 23. Further, a feedback signal is also applied to the controller 20 from the servomotor 19. On the basis of these signals, the controller 20 calculates fuel injection amount, injection timing and ignition timing, and switches operation mode from the two cycle mode (where fuel injection and ignition are effected once for each reciprocation of the piston 3) to the four cycle mode (where fuel injection and ignition are effected once every two reciprocations of the piston 3) or vice versa. Further, there exist two manual and automatic operation switching modes. In the manual switching mode, the operation mode is switched compulsorily whenever a signal is inputted from the mode selection switch 23 to the controller 20. In the automatic switching mode, the operation mode is switched automatically according to engine operating conditions.

Figure 3:
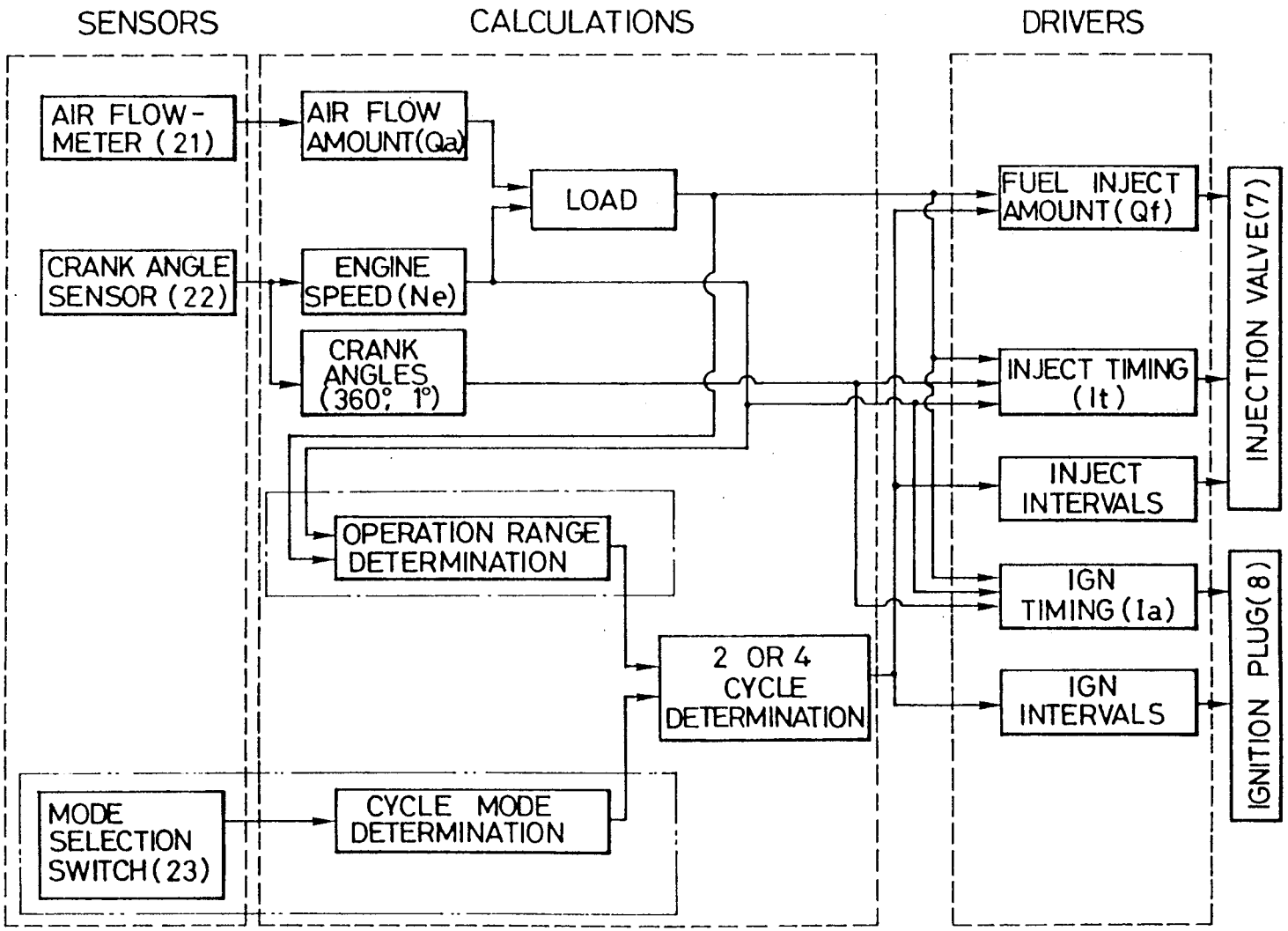
FIG. 3 is a block diagram for assistance in explaining control operations of the controller.

FIG. 3 is a block diagram for assistance in explaining the operation of the controller 20. The controller 20 calculates the current amount of intake air $Q_a$ on the basis of signals from the air flowmeter 21, the current engine rotative speed $N_e$ on the basis of signals from the crank angle sensor 22, and the current crank angular position (360° position and 1° position) on the basis of signals also from the crank angle sensor 22. Further, the controller 20 further calculates the current engine load on the basis of the calculated intake air amount $Q_a$ and the engine speed $N_e$. According to calculated engine load, the amount $Q_f$ of fuel to be injected is calculated; the fuel injection timing $I_f$ is determined on the basis of the calculated engine load and engine speed; and fuel injection timing signals are outputted to the fuel injection valve 7 in synchronism with the crank angular position signal. In the same way, the ignition timing $I_a$ is determined on the basis of the calculated engine load and engine speed; and fuel ignition timing signals are outputted to the ignition coil 9 in synchronism with the crank angular position signal.

Figure 2:
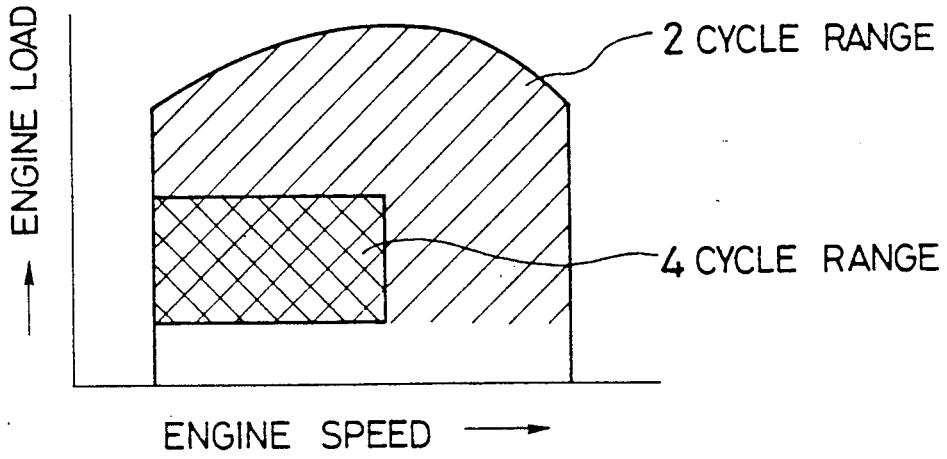
FIG. 2 is a graphical representation showing an example of operation mode switching ranges, in which two and four cycle engine operation modes are switched under consideration of engine speed and engine load.

Further, the operation range is determined on the basis of the calculated engine load and engine speed. As shown in FIG. 2, for instance, the operation mode can be switched automatically in such a way that the four cycle mode is selected under medium load at low to medium engine speed and the two cycle mode is selected under other conditions. In the same way, the operation mode can be switched manually, according to the driver's preference, in response to the signal from the operation mode selection switch 23.

On the basis of the signal from the switch 23, the operation cycle mode is determined. When either two or four cycle mode is determined on the basis of the operation range determination (in automatic operation) or the cycle mode determination (in manual operation), the injection and ignition intervals are changed according to two or four cycle operation mode. In the two cycle operation mode, fuel injection and ignition can be effected once for each engine revolution; in the four cycle operation mode, fuel injection and ignition can be effected once every two engine revolutions. Signals indicative of calculated fuel inject amount $Q_f$, the calculated injection timing $I_f$ and the determined injection intervals are supplied to the fuel injection valves 7, and signals indicative of the calculated ignition timing $I_a$ and the determined ignition intervals are supplied to the fuel ignition plugs 8 (or ignition coils 9). Further, the exhaust port 11 is opened or closed by the exhaust control valve 18 actuated by the servomotor 19 controlled by the controller 20 according to the two or four cycle operation mode.

The operation of the engine will be described hereinbelow. When the operating condition is in two cycle operation mode, fuel is injected once from the fuel injection valve 7 for each engine revolution by the controller 20 and further ignited by the ignition plug 8. Therefore, when the piston 3 comes down after explosion, the exhaust port 11 is first opened for exhaust stroke and then the scavenging port 10 is opened to feed new air from the crank prepressurizing chamber 12 while scavenging the combustion gas. When the pressure of air within the chamber 12 drops, new air is introduced into the chamber 12 again through the intake throttle valve 16 linked with the accelerator pedal 15. Thereafter, when the piston 3 goes upward, since the scavenging port 10 and the exhaust port 11 are both closed in sequence, compression stroke begins. When the piston 3 approaches the upper dead point of compression, fuel is injected from the fuel injection valve 7 at predetermined timing and further ignited by the ignition plug 8, so that a mixture gas is ignited and burnt at the explosion expansion stroke. Thereafter, when the piston 3 comes down, the same exhaust and scavenging operations are repeated. In this two cycle operation mode, since the number of explosion is large, it is possible to increase the engine speed and engine output power.

In contrast with this, when the operating condition is in four cycle operation mode, fuel is injected and ignited once every two engine revolutions.

Therefore, after the piston 3 comes down due to explosion (at explosion stroke), the pistons 3 goes upward to exhaust the exploded mixture through the exhaust passage 17 (at exhaustion stroke). After exhaustion, the piston 3 comes down again to introduce new air through the intake passage 14 (at suction stroke). When the piston 3 reaches the upper dead point (at compression stroke), fuel is injected and ignited for explosion. In other words, mixture is compressed and exploded during the first reciprocation of the piston 3 and exploded mixture is exhausted and replaced with new air during the second reciprocation thereof. In this case, since fuel is directly supplied into the combustion chamber 6, without passing through an intake passage, through a carburetor, it is possible to supply fuel intermittently without blowing the supplied fuel into an exhaust system at the succeeding exhaust stroke.

As a result, since the exploded mixture within the combustion chamber can be replaced with new air almost perfectly before ignition, the amount of residual combustion gas is extremely small. Therefore, in four cycle operation mode, it is possible to effect stable combustion and therefore improve the fuel combustion rate.

As described above, since the operation mode can be switched by changing only the fuel injection timing and fuel ignition timing, it is possible to simplify the structure for switching the operation modes, without providing intake-valves, exhaust valves, and the associated valve driving mechanism.

Figure 4:
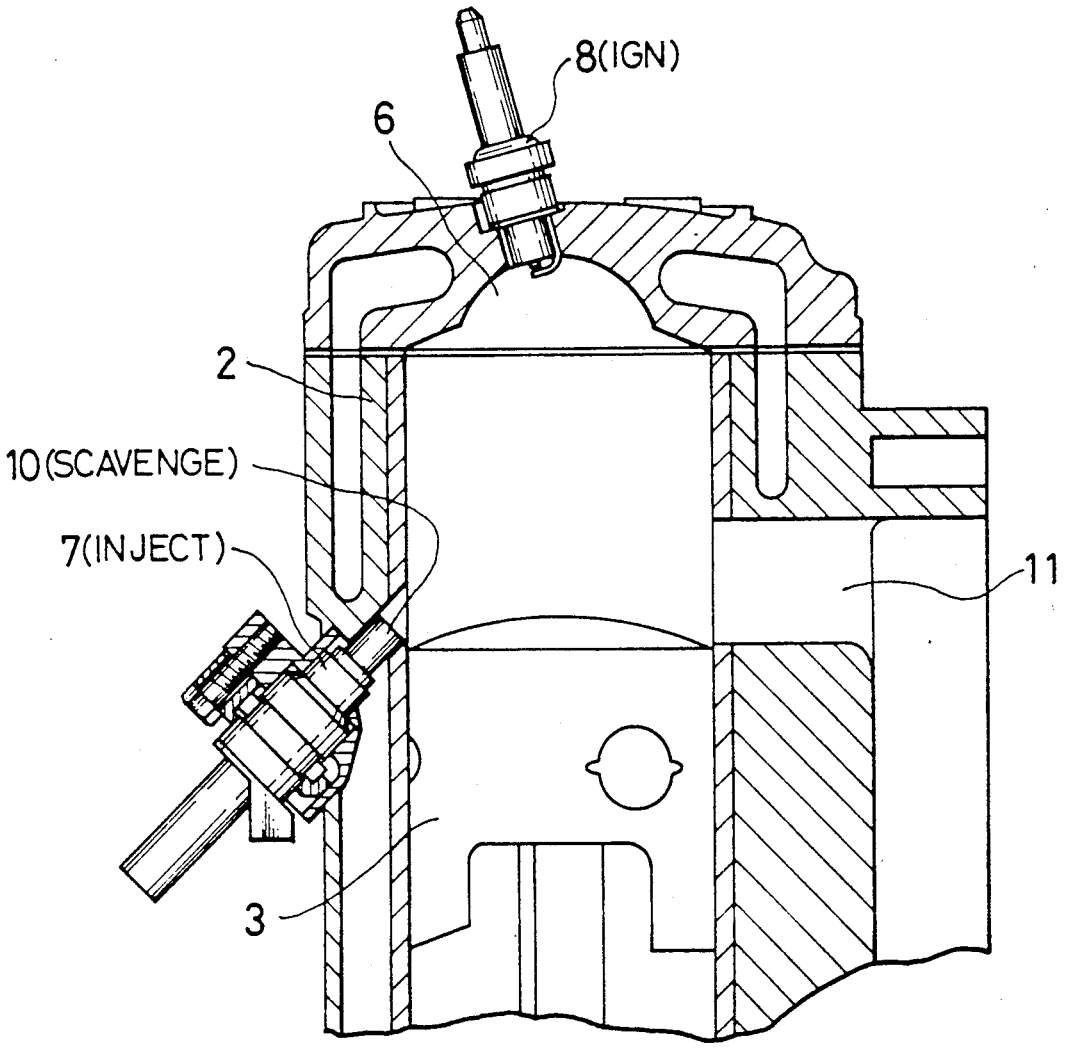
FIG. 4 is an enlarged longitudinal cross-sectional view showing and essential portion of another embodiment of the present invention.

Further, as shown in FIG. 4, it is possible to provide the fuel injection valve 7 within the scavenging port 10 opening to the combustion chamber 6 (without providing it within the combustion chamber 6). In this embodiment, fuel is injected before the scavenging port 10 is closed by the piston 3. In this case, since the pressure within the combustion chamber is low when fuel is injected, it is possible to use an ordinary low pressure fuel injection nozzle used for injecting fuel into an intake passage.

Further, in the above description, the operation modes can be switched both manually and automatically. However, it is of course possible to switch the operation modes in either manually or automatically.

As described above, in the double cycle internal combustion engine according to the present invention, the scavenging port and the exhaust port are formed in the wall surface of the cylinder so as to be opened or closed according to the piston position; the fuel injection valve (for directly inject fuel) and the fuel ignition plug (for igniting mixture) are provided within the combustion chamber; and the controller is provided for switching the fuel injection and ignition so as to be effected for each engine revolution or every two engine revolutions, it is possible to switch two cycle operation mode to four cycle operation mode or vice versa by only switching the fuel injection and ignition timings. That is, since the operation mode switching structure is simplified markedly and further additional intake valves, exhaust valves and valve actuating mechanisms are not required, it is possible to simplify the valve system construction and minimize the valve system weight.

What is claimed is:

1. A double cycle internal combustion engine, comprising:

(a) a cylinder formed with a scavenging port and an exhaust port;

(b) a piston slidably fitted to said cylinder, the scavenging and exhaust ports being opened or closed, respectively, when said piston is slidably moved within said cylinder;

(c) a fuel injection valve, provided near an upper portion of said cylinder, for injecting fuel into said cylinder;

(d) a fuel ignition plug, also provided near the upper portion of said cylinder, for igniting a mixture of fuel injected through said fuel injection valve and air introduced through the scavenging port into said cylinder;

(e) detecting means for detecting engine operating conditions and for producing an electronic output signal indicative thereof; and (f) electronic control means, electronically coupled to said fuel injection valve, said fuel ignition plug, and said detecting means, for electronically switching engine operation from a two cycle mode to a four cycle mode or vice versa according to the engine operating conditions detected by said detecting means, and for electronically activating said fuel injection valve and said fuel ignition plug every engine revolution in two cycle mode and every two engine revolutions in four cycle mode.

2. The double cycle internal combustion engine of claim 1, wherein said engine operating conditions detected by said detecting means are engine load and engine speed.

3. The double cycle internal combustion engine of claim 2, wherein the engine operation is switched to the four cycle mode only when the detected engine load and speed are both lower than predetermined medium values, respectively, and to the two cycle mode when at least one of the detected engine load and speed is the predetermined medium value or higher.

4. The double cycle internal combustion engine of claim 1, which further comprises:

(a) a one-way valve disposed between the scavenging port and an engine intake passage; and an intake throttle valve disposed in the engine intake passage and associated with an accelerator pedal.

5. The double cycle internal combustion engine of claim 1, which further comprises:

(a) an exhaust control valve disposed in the exhaust port; and (b) a servomotor, coupled between said exhaust control valve and said control means, for adjusting an opening rate of said exhaust control valve according to engine operating conditions detected by said detecting means.

6. The double cycle internal combustion engine of claim 1, which further comprises a mode selection switch, coupled to said control means, for manually switching the engine operation mode from the two cycle mode to the four cycle mode or vice versa.

7. The double cycle internal combustion engine of claim 1, wherein said detecting means comprises:

(a) an air flowmeter for detecting an amount of intake air introduced into said cylinder; and (b) a crank angle sensor for detecting crank angular positions.

8. The double cycle internal combustion engine of claim 7, wherein said control means comprises:

(a) first means, coupled to said crank angle sensor, for calculating an engine speed on the basis of signals outputted by said crank angle sensor;

(b) second means, coupled to said air flowmeter and said first means for calculating an engine load on the basis of signals outputted by said air flowmeter and the calculated engine speed;

(c) third means, coupled to said first and second means, for determining the four cycle mode when the calculated engine load and speed are both lower than predetermined medium values, respectively and the two cycle mode when the calculated engine load and speed are both the predetermined medium values or higher, respectively.

(d) fourth means, coupled to said second and third means, for calculating an amount of fuel to be injected into said cylinder through said fuel injection valve;

(e) fifth means, coupled to said first and second means and said crank angle sensor, for determining fuel injection timing at which the fuel is injected to said cylinder through said fuel injection valve in synchronism with a crank angle sensor signal;

(f) sixth means, coupled to said third means, for determining fuel injection intervals at which the fuel is injected;

(g) seventh means, coupled said first and second means and said crank angle sensor, for determining fuel ignition timing at which the injected fuel is ignited through said fuel ignition plug in synchronism with a crank angle sensor signal; and (h) eighth means, coupled to said third means, for determining fuel ignition intervals at which the injected fuel is ignited.

9. The double cycle internal combustion engine of claim 1, wherein said fuel injection valve is attached to a position where the scavenging port is open to said cylinder.

10. A method of operating a double cycle internal combustion engine, comprising the steps of:

(a) detecting an amount $Q_a$ of air introduced into an engine cylinder;

(b) detecting crank signals indicative of crank angular positions;

(c) calculating engine speed on the basis of the detected crank signals;

(d) calculating engine load on the basis of the detected air amount and the calculated engine speed;

(e) selecting either one of two and four engine operation cycles according to the calculated engine load and speed;

(f) determining an amount $Q_f$ of fuel to be injected on the basis of the calculated load and the selected operation cycle;

(g) determining a fuel injection timing $I_f$ on the basis of the calculated engine load and speed in synchronism with a crank signal;

(h) determining a fuel ignition timing $I_a$ on the basis of the calculated engine load and speed in synchronism with a crank signal;

(i) determining fuel injection and ignition intervals on the basis of the selected engine operation cycle;

(j) activating a fuel injection valve on the basis of the determined fuel injection amount, timing and intervals; and (k) activating a fuel ignition plug on the basis of the determined ignition timing and intervals.

11. The method of claim 10, wherein the four cycle engine operation is selected only when the calculated engine load and speed are both lower than predetermined medium values, respectively and the two cycle engine operation is selected when at least one of the detected engine load and is the predetermined medium value or higher.

12. The method of claim 10, which further comprises a step of manually selecting either one of the two engine operation cycles.

* * * * *